US006880708B2

(12) United States Patent
Boron

(10) Patent No.: US 6,880,708 B2
(45) Date of Patent: Apr. 19, 2005

(54) PRODUCT DISPLAY RACK

(75) Inventor: Andrew J. Boron, Belleville, IL (US)

(73) Assignee: PFI, LLC, St. Louis, MO (US)

( * ) Notice: Subject to any disclaimer, the term of this patent is extended or adjusted under 35 U.S.C. 154(b) by 11 days.

(21) Appl. No.: 10/064,637

(22) Filed: Aug. 1, 2002

(65) Prior Publication Data

US 2004/0020878 A1 Feb. 5, 2004

(51) Int. Cl.[7] ..... A47F 1/04

(52) U.S. Cl. ..... 211/59.2; 211/74; 211/194; 211/189; 211/188

(58) Field of Search ..... 211/59.2, 196–199, 211/194, 90.1–90.04, 189, 181.1, 105, 106, 74, 85.17, 85.18, 134; 312/42, 45, 72, 128, 126, 107; 108/91, 106, 107, 144.11, 147.11

(56) References Cited

U.S. PATENT DOCUMENTS

| | | | | | |
|---|---|---|---|---|---|
| 3,465,898 | A | * | 9/1969 | Klein | 211/194 |
| 3,502,227 | A | * | 3/1970 | Konstant et al. | 211/194 |
| 4,099,472 | A | * | 7/1978 | Kellogg | 108/185 |
| 4,312,086 | A | * | 1/1982 | Bianco | 5/2.1 |
| 4,344,367 | A | * | 8/1982 | Merl | 108/1 |
| 4,531,646 | A | | 7/1985 | Howard | 211/150 |
| 4,600,231 | A | * | 7/1986 | Sickles | 294/161 |
| 4,633,788 | A | * | 1/1987 | Robertson | 108/108 |
| 4,763,796 | A | | 8/1988 | Flum | 211/59.2 |
| 4,930,643 | A | | 6/1990 | Flum | 211/188 |
| 4,976,360 | A | * | 12/1990 | Zucker et al. | 211/186 |
| 5,048,701 | A | * | 9/1991 | Simpson | 211/189 |
| D334,859 | S | | 4/1993 | Homann | D6/509 |
| 5,201,191 | A | * | 4/1993 | Bustos | 62/249 |
| 5,411,153 | A | * | 5/1995 | Unfried | 211/188 |
| 5,417,333 | A | | 5/1995 | Flum | 211/59.2 |
| 5,439,123 | A | * | 8/1995 | Nook | 211/187 |
| D368,396 | S | | 4/1996 | Bidwell | D6/479 |
| 5,547,088 | A | * | 8/1996 | Belokin et al. | 211/87.01 |
| 5,588,541 | A | * | 12/1996 | Goetz | 211/188 |
| 5,924,577 | A | * | 7/1999 | Gessert | 211/41.1 |
| 5,947,307 | A | * | 9/1999 | Battaglia et al. | 211/187 |
| 6,029,833 | A | * | 2/2000 | Yeh | 211/189 |
| 6,089,387 | A | * | 7/2000 | Varfolomeeva | 211/181.1 |
| 6,135,299 | A | * | 10/2000 | Burgess | 211/194 |
| 6,241,106 | B1 | * | 6/2001 | Fujita et al. | 211/134 |
| 6,279,763 | B1 | * | 8/2001 | Bush | 211/195 |
| 6,328,170 | B1 | * | 12/2001 | Lee | 211/59.2 |
| 6,405,880 | B1 | * | 6/2002 | Webb | 211/59.2 |
| 6,467,856 | B1 | * | 10/2002 | Chang et al. | 312/108 |
| 2002/0027115 | A1 | * | 3/2002 | Gay et al. | 211/187 |
| 2002/0130098 | A1 | * | 9/2002 | Simard | 211/181.1 |

* cited by examiner

*Primary Examiner*—Carl D. Friedman
*Assistant Examiner*—Jennifer E. Novosad
(74) *Attorney, Agent, or Firm*—Blackwell Sanders Peper Martin LLP

(57) ABSTRACT

A display rack including a plurality of subassemblies which are removably stackably arranged one on top of the other to achieve a particular display rack height. Each subassembly includes a plurality of upright support members and a plurality of shelf members which are adjustably positionable between a substantially flat horizontal orientation and a gravity feed orientation. Each shelf member includes a removably attachable product organizer member which cooperates with the respective shelf members to align and guide products positioned thereon within segregated product channels. The present display rack may also include a plurality of side shelf members which are removably attachable to the side portions of each of the subassemblies for providing additional shelf space, and the present display rack may include a header assembly which is removably attachable to the upright support members associated with the uppermost subassembly forming the present display rack.

29 Claims, 7 Drawing Sheets

PRODUCT DISPLAY RACK

BACKGROUND OF THE INVENTION

A product display rack for in store display of consumer items such as packaged foods and beverages.

Successful marketing of consumer items often times is dependent on how effectively the product is displayed. Effectiveness is in part determined by the location of the product within a retail outlet and the location of the particular products on the shelves. Typically, consumer items, and particularly foods and beverages, are displayed on permanent shelving in aisles throughout a retail store. Staple items tend to be placed on lower shelves because consumers will seek them out. However, impulse items are particularly sensitive to marketing techniques and, in particular, they are sensitive to the location of the products within a store and their location on the shelves within the store. Impulse items are preferably displayed at premium locations throughout a particular store to encourage and promote the sales of these products. Premium locations may include end of aisle locations, point of purchase locations at checkout counters, and/or other promotional locations within a particular store environment. Impulse items are often times likewise displayed at eye level on conventional shelving to promote easy visibility and access.

Permanent shelves however are fixed in position in the store and the products displayed thereon are displayed amongst many other products sometimes making them somewhat difficult to acquire and locate. It is believed that product positioning on conventional shelves is not as effective in marketing certain products as other locations in the store. End of aisle and check out displays are considered premium locations for positioning products particularly impulse items. However, it is expensive for a supplier to have its products displayed at premium locations and often times budgets will not allow continuous long term display in such premium locations. Because of the wide variety of products and the way suppliers desire to display such items, conventional shelving often times will not suffice necessitating specialty display racks. Specialty display racks are however often times dedicated to a particular product container and lack versatility to merchandise and display other products. Such display racks, if dedicated to a specific brand of product, cannot be easily converted, if at all, for use with other brands of products thereby limiting their scope of use by a retailer and reducing its desirability. Thus, a display rack should be changeable so that a supplier or retailer can reposition the product to a desired location on the rack or change the product being displayed thereon.

Another problem with known display racks is that they need to be sufficiently strong and durable for holding a significant amount of weight particularly when the products are soft drinks or other beverage products. Display racks for end of aisle displays are typically large and have many parts but should be easy and inexpensive to ship. Such display racks also need to be easy and quick to assemble by store personnel.

Thus, there is a need for an improved product display rack that is effective to overcome the above problems.

SUMMARY OF INVENTION

The present invention relates to a versatile product display rack that can be packaged for shipping in preassembled sections and which can be quickly and easily assembled at a retail outlet. The present display rack includes a plurality of display shelves that include product organizer members moveable between the various shelves to provide storage for variously shaped and sized product containers while maintaining the containers in a preset arrangement on the shelves. The present display rack is also fabricated into a plurality of stackable subassemblies having cooperating attachment means allowing simple connection of one subassembly to another subassembly to produce an assembled display rack. Additional shelves are also provided for removable attachment to the exterior side portions of the display rack providing still additional product display space.

BRIEF DESCRIPTION OF DRAWINGS

Like numbers throughout the drawings designate like or similar parts.

DETAILED DESCRIPTION

Figure 1:
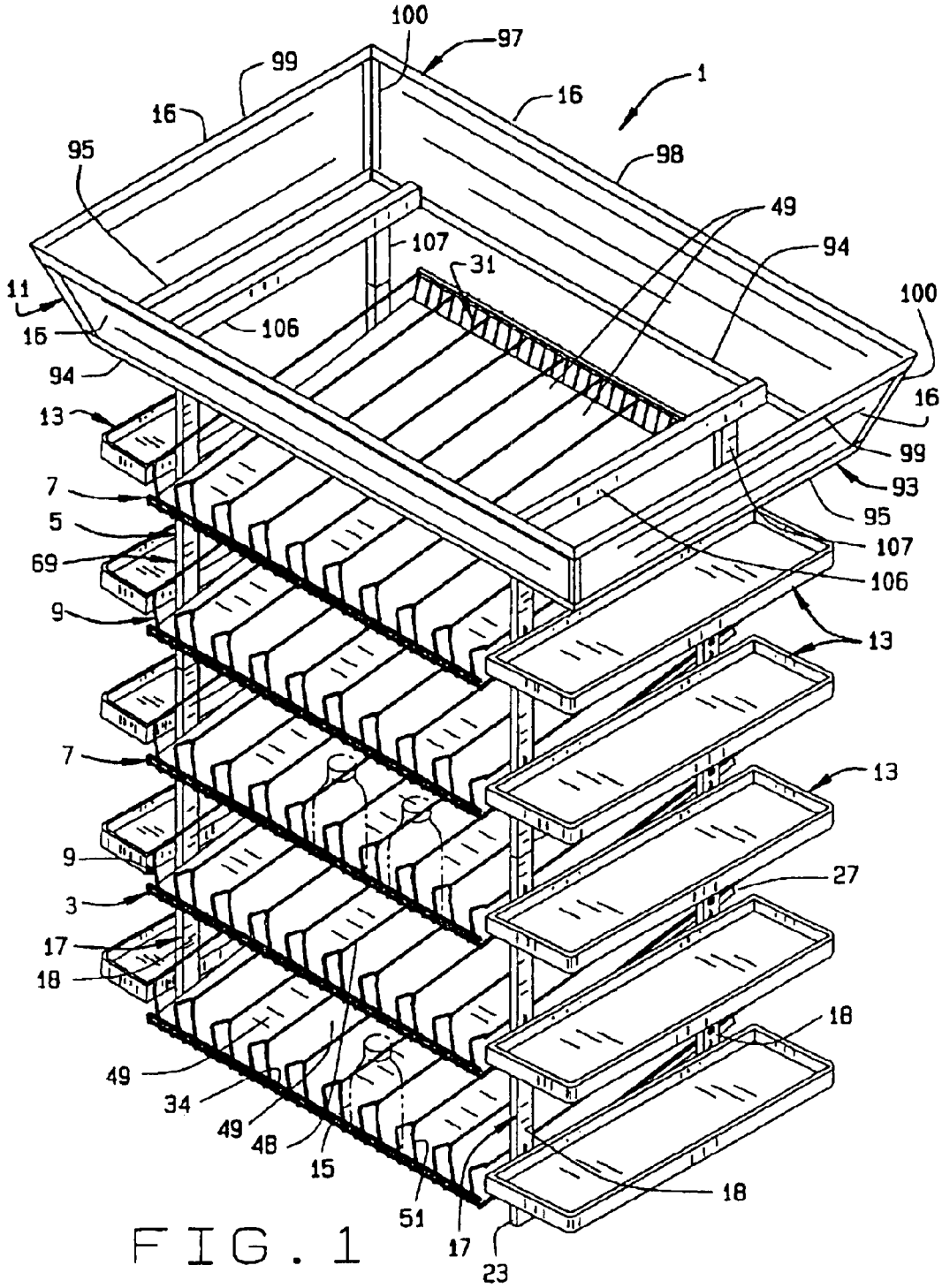
FIG. 1 is a perspective view of a product display rack including a main rack portion, an auxiliary side shelf portion, and an advertising header.

The referenced numeral 1 designates generally a product display rack comprising a base or lower shelf unit (subassembly) 3, an upper shelf unit (subassembly) 5 mounted onto the base unit 3, a plurality of shelf members 7 with product organizer members 9, an advertisement header assembly 11, and auxiliary side shelf members 13. The display rack 1 is adapted for supporting and displaying a plurality of different product containers 15 (FIGS. 1 and 4), for example, beverage products such as containers of soft drinks, and the display rack 1 is adapted for use in a wide variety of different retail outlets for displaying the products 15 at any suitable location within the retail environment. The rack 1 is constructed for loading and stocking from either the front or the rear of the unit, as desired, and may be easily moved from one location to another location within the retail outlet. The display header 11 is operable for supporting changeable panels 16 to advertise the products 15 displayed on the rack 1.

Figure 2:
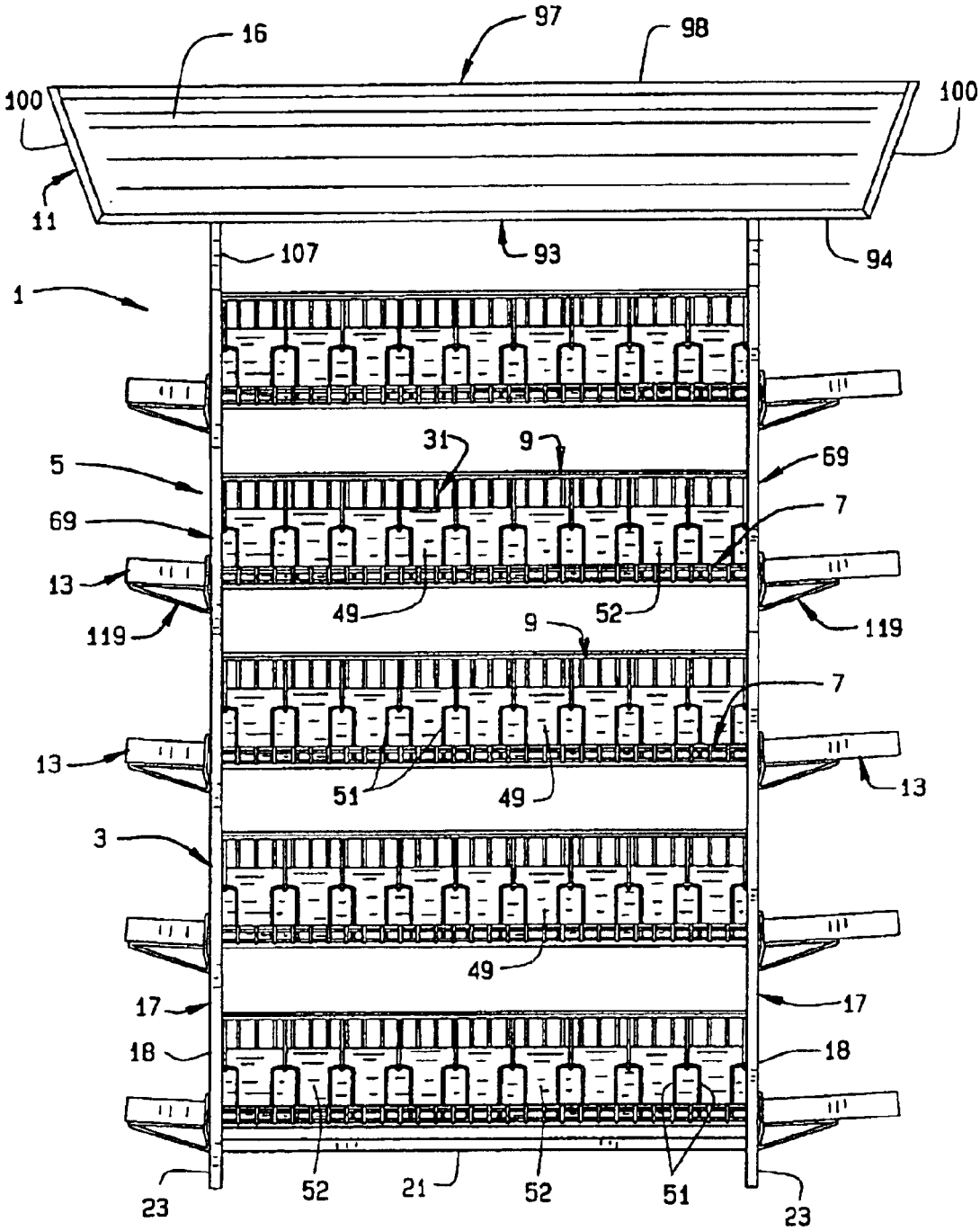
FIG. 2 is a front elevational view of the product display rack of FIG. 1.
Figure 3:
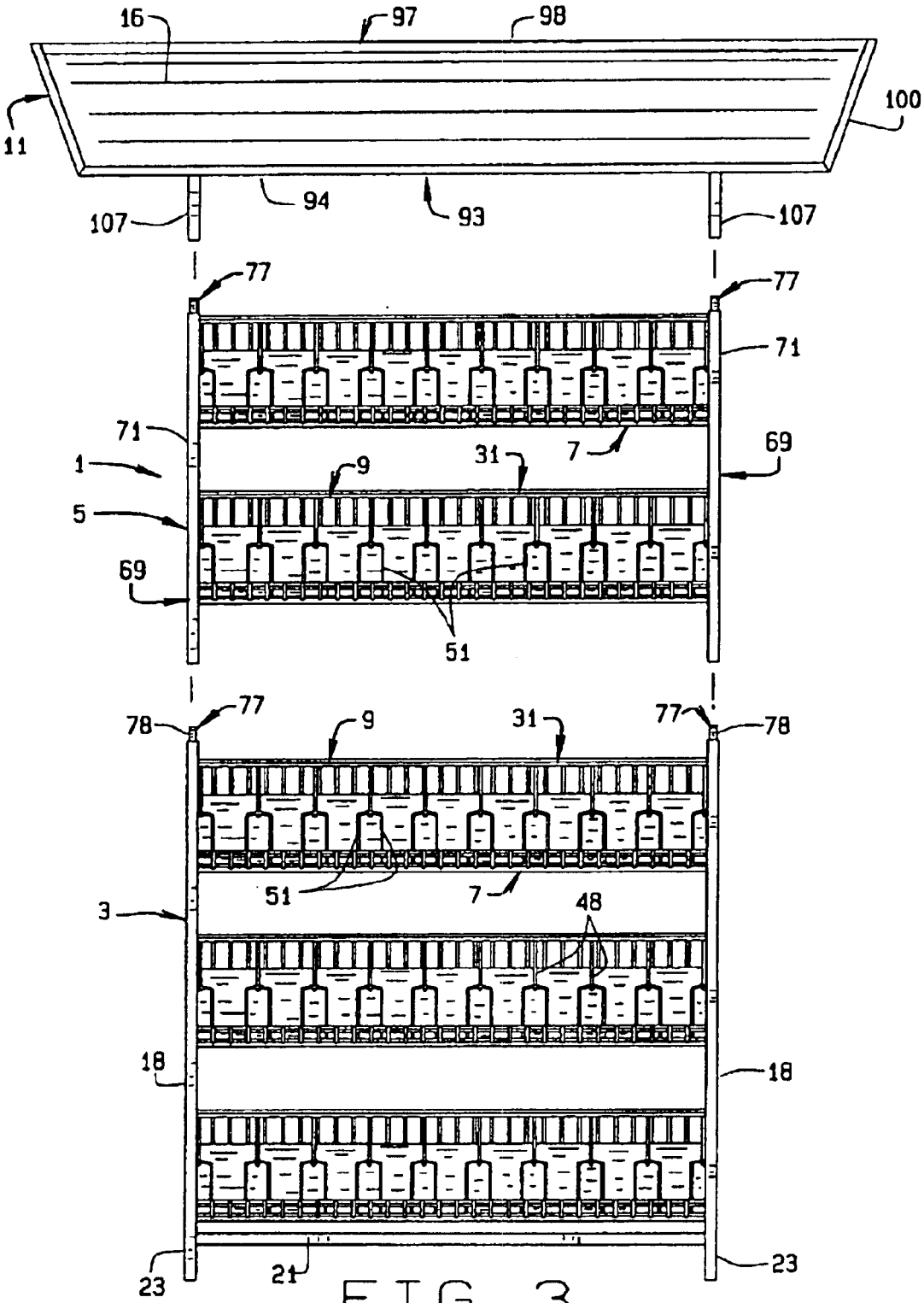
FIG. 3 is an exploded front elevational view of the product display rack of FIG. 1 with the auxiliary side shelves removed.
Figure 4:
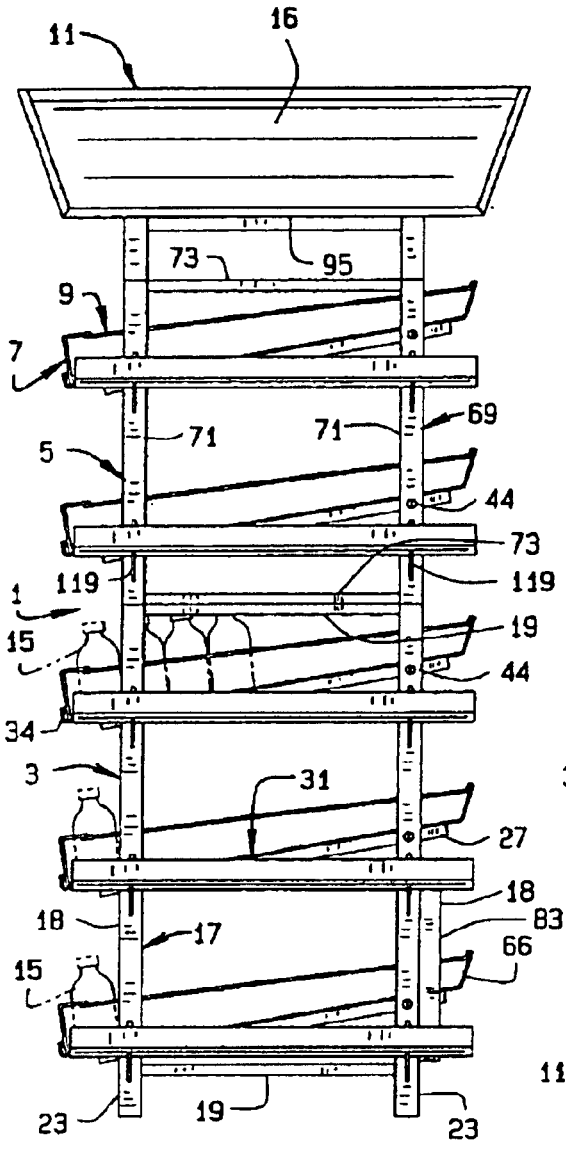
FIG. 4 is a side elevational view of the product display rack of FIG. 1.
Figure 5:
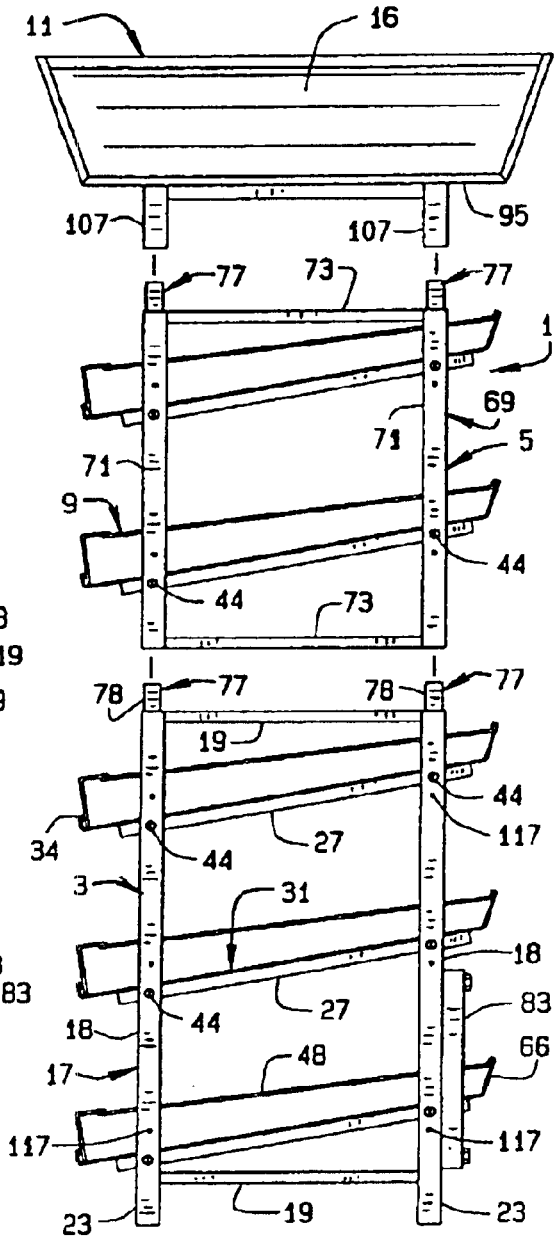
FIG. 5 is an exploded side elevational view showing the product display rack of FIG. 1 from the same point of view as FIG. 4.

The base or lower unit 3 includes a plurality of upright generally rectangular support structures 17 for supporting shelf members 7 and 13 thereon as desired. The support structures 17 are also operable for supporting at least one upper unit 5 positioned thereabove. In the illustrated embodiment, there is a support structure 17 on each opposite side of the base unit 3 and each structure 17 includes a pair of upright columns or posts 18 secured together by upper and lower front-to-back extending braces 19 (FIGS. 4 and 5). Also, side-to-side braces 21 (FIGS. 2 and 3) are secured to the columns 18 adjacent the lower ends thereof at the front and rear of the base unit 3 to provide a rigid framework on which the shelf members 7 can be mounted. The columns 18 and braces 19 and 21 can be secured together by any suitable means such as by welding. Preferably, the columns 18 and braces 19 and 21 are made of rectangular hollow tubing for simplifying the manufacturing of the base unit 3, although other configurations and other support members can likewise be utilized. In addition, the lower portions 23 (FIGS. 1–5) of the columns 18 form legs for spacing the braces 19 and 21 above the supporting surface or floor on which the rack 1 rests to provide clearance for a lifting device such as a pallet jack which may be used to lift and move the rack 1 from one location to another within the retail environment. The lower portions 23, the braces 19 and 21, and the upright support columns or posts 18 form the base unit 3 for supporting the remainder of the rack 1 while providing the space thereunder to facilitate moving and/or cleaning under the rack 1. The columns 18 and therefore the lower portions 23 are positioned at the respective corners of the base unit 3 thereby forming a rectangular array as best shown in FIGS. 1–5.

The shelf members 7 (FIGS. 1–5) are positioned in vertically spaced relation on the support structures 17 and are adapted for storing and displaying the products 15 thereon. In the illustrated embodiment, the shelf members 7 include front-to-rear extending beams 27 (FIGS. 4–5) which are preferably secured to a pair of respective columns 18 via screw fasteners 44. In this regard, any plurality of apertures (not shown) for receiving the screw fasteners 44 can be vertically spaced along the upright support columns or members 18 so as to vary the orientation of the shelf member 7 relative to the horizontal such as between a substantially flat horizontal orientation and any number of gravity feed orientations. Cross beams 29 (FIG. 9), which are in the form of upwardly opening U-shaped channels, are secured to and extend between the beams 27 at the front and rear of each shelf member 7. Wire racks 31 as best illustrated in FIG. 8 are attached to the respective cross beams 29 of each shelf member 7 and form a product support surface extending between the opposed front and rear portions and the opposed side portions of the base unit 3.

The wire racks 31 may be permanently secured to the cross beams 29 or they may be removably attached in any suitable manner. The wire racks 31 each have a plurality of spaced front-to-rear extending wires 32 arranged in a common plane to form a support surface for positioning products directly positioned thereon. Each of the wires 32 has an angularly disposed upwardly extending portion 34 forming an upturned lip as best shown in FIGS. 8 and 9. Each wire portion 34 is attached at its upper end to a side-to-side transverse rail member 35 which projects toward the rear of the wire rack 31 as best shown in FIG. 9. A price rail 37 may be secured to the wire portions 34, as for example, by welding or other suitable attachment means. The rack 31 provides an upwardly facing support surface 39 adapted to support an optional panel 40 which will cover the openings between the spaced wires 32 at the surface 39 and provide a continuous supporting surface, if necessary, depending upon the particular types of products being merchandised therefrom. A ribbed product contact mat or track member 41 can likewise be optionally positioned either on top of the panel 40 or directly on top of the wires 32 to improve the slidability of the products 15 positioned thereon, particularly if the shelf members 7 are attached in a gravity feed orientation. In this regard, the shelf members 7 may be inclined downwardly from the back to the front of the rack 1 to assist in gravity feeding the product containers 15 towards the front of each respective shelf member. The shelf members 7 may be secured in any suitable manner to the support structures 17 as, for example, through the use of the screw fasteners 44 illustrated in FIGS. 4 and 5 which extend through aligned apertures (not shown) associated with both the columns 18 and the side beams 27. It is noted, however, that any suitable attachment means may be utilized to accomplish this task. Also, preferably the shelf members 7 are removably mountable to the support structures 17 so that the spacing between respective shelf members 7 may be varied to accommodate product containers of different sizes and/or to reorient a particular shelf member 7 from a gravity feed orientation to a substantially flat horizontal orientation and vice versa. Any number of appropriately spaced apertures on the support members 18 may be utilized to accomplish this purpose.

Figure 8:
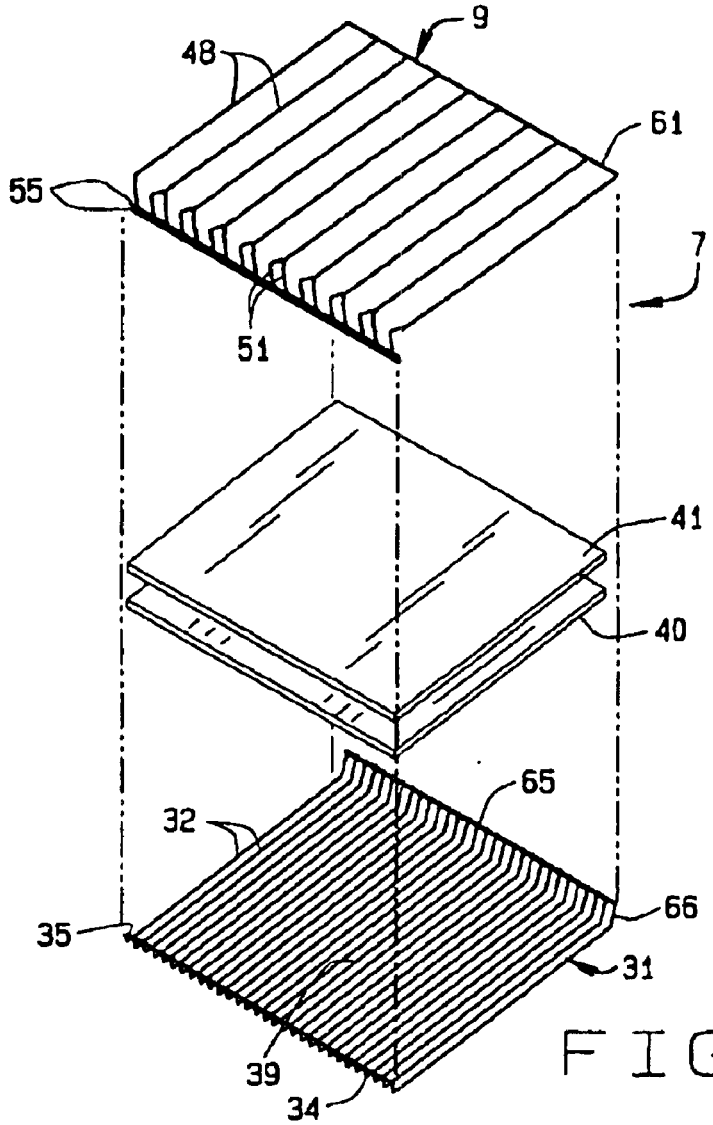
FIG. 8 is an exploded perspective view showing the component parts of a main product display shelf member associated with the product display rack of FIG. 1.
Figure 9:
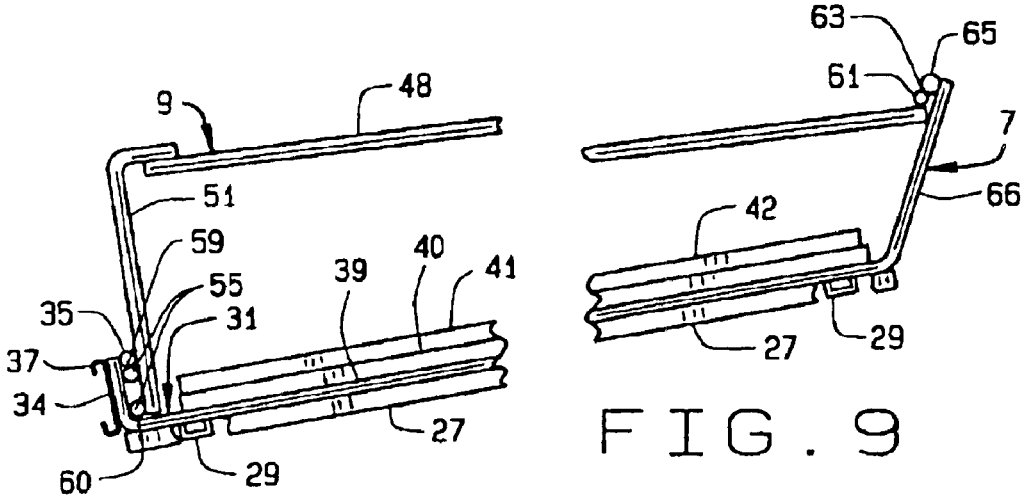
FIG. 9 is an enlarged fragmentary side view of the main product display shelf member of FIG. 8.

In a preferred embodiment of the present invention, the rack 1 includes product organizer members 9 as best shown in FIGS. 1, 8 and 9, the organizer members 9 including spaced front-to-rear extending wires 48 that form guide rails at opposite sides of product receiving channels 49 for supporting the product containers 15 therebetween. The wires 48 are used to organize and separate the product containers 15 into separate rows or product channels 49 extending from the front toward the rear of each shelf member 7. Preferably, the wires 48 are spaced above the track surface 41 a distance sufficient to properly support and retain the product containers 15 in an upright orientation within each product channel 49. Wires 51 configured as shown in FIGS. 1, 2 and 8 may be provided at the front end of each wire 48 extending generally downwardly therefrom, adjacent wires 51 forming a product retention throat or gate opening 52 at the front of each product channel 49, the gate opening 52 having a dimension less than the width of the product container 15. The adjacent wires 51 in each product channel 49 (gate opening 52) prevent the product containers 15 from sliding forward off of the shelf member 7. Removal of the product containers 15 may be simply accomplished by moving the forwardmost product container 15 upwardly until it clears the respective gate opening 52. The organizer member 9 also includes cooperative latch devices operable to cooperate with the wire rack 31 for removably attaching the front and rear portions thereof to the front and rear portions of the wire rack 31. In the illustrated embodiment, the latch devices include a pair of side-to-side extending wires 55 secured to the downwardly extending gate wires 51 (FIG. 9). The side-to-side transversely extending wires 55 form upper and lower shoulder portions 59 and 60 respectively. When the organizer member 9 is positioned on top of the wire rack 31, the lower shoulder 60 will engage and rest on the rack 31 adjacent to the intersection of wires 32 and 34, and the upper shoulder 59 will engage the underside portion of transverse rail member 35 thereby retaining the entire front portion of the organizer member 9 in the space underneath rail member 35 and adjacent wire portions 34 as best illustrated in FIG. 9. A transverse wire 61 is secured to the rear portion of the wires 48 and extends from side-to-side across the rear portion of the organizer member 9 as best shown in FIGS. 8 and 9. The wire 61 forms an upwardly facing shoulder 63 which will be positioned under a cross-wire 65 which is secured to an upturned wire portion 66 positioned at the rear of the wire rack 31. By having the wires 48 of the correct length, they can exert force, in a resilient manner, to retain the wires 55 in engagement under the wire 35 and to retain the wire 61 in engagement under the wire 65. The wire portions 66 taper downwardly and inwardly from the cross wire 65 to resist movement of the back end of the organizer member 9 in a downward direction relative to the product support surface 39, 40 or 41. The organizer member 9 is thus removably attached to the wire rack 31 facilitating its removal, installation and transfer from shelf to shelf. In those situations where the organizer member 9 is not needed, the wire rack 31, with or without use of the support members 40 and/or 41, can be used to support products directly thereon.

Because product containers vary in size, the organizer member 9 including the gate opening 52 can be fabricated to accommodate any particular product container size and shape. As a result, any number of differently sized organizer members 9 can be made, each being adaptable for engagement with the wire rack 31 as previously described. Depending upon the size and shape of the product containers 15 being merchandised for each shelf member 7, the appropriate organizer member 9 can be utilized therewith, including a differently sized organizer member 9 with each shelf member 7.

The rack 1 also includes at least one upper shelf unit 5 that is likewise adapted for supporting product containers 15 for display and for removable attachment to the underlying base shelf unit 3. The shelf units 3 and 5 form subassemblies which, when connected together, form the overall rack 1. While only one upper shelf unit 5 is illustrated, it is understood that any plurality of upper units 5 may be utilized with the structure of the upper units 5 being preferably generally the same and interchangeable. The use of subassemblies facilities packaging and shipping. The upper unit 5 likewise includes a pair of support structures 69 which are each preferably generally rectangular frames, each support structure 69 including a pair of upright columns or posts 71 and upper and lower front-to-rear braces 73. Preferably the side braces 73 and upright columns 71 are made of hollow rectangular tubing for ease of assembly and weight reduction, although other support structure configurations may likewise be utilized. The shelf members 7 are secured to and extend between the support structures 69 as previously described with respect to the base unit 3, such as with the fasteners 44, to form the upper unit 5. It is preferred that the upper unit 5 not have side-to-side cross braces, like the cross braces 21, permanently secured to the support structures 69, but rather that the shelf members 7 provide the structural integrity for securing the support structures 69 together. This open front and rear construction provides improved access to the product containers 15 positioned within each shelf member 7.

Figure 6:
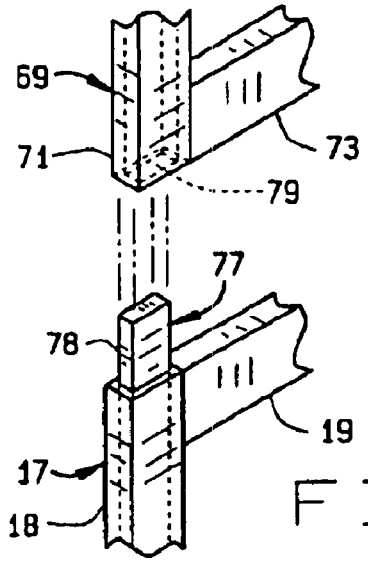
FIG. 6 is an enlarged, exploded fragmentary perspective view of the stake and socket arrangement used to connect the various subassemblies of the product display rack of FIG. 1 to one another.

Connectors are provided for allowing the removable attachment of an upper shelf unit 5 to a lower shelf unit in stacked or superimposed relation such as for example, the base unit 3. The connectors include cooperating attachment means associated with an upper and lower unit. In a preferred embodiment, as best seen in FIGS. 3, 5 and 6, the connectors permit the attachment of an upper unit 5 to a lower unit by relative longitudinal movement. As shown, stakes 77 are secured to an upper portion of the lower unit 3 projecting upwardly therefrom, each stake 77 having a portion thereof secured within the interior of a corresponding column 18. Securement can be via an interference fit, screw fasteners, welding, an adhesive, or the stakes 77 could be integrally form with the columns 18. A portion 78 of each of the stakes 77 extends upwardly and out of each of the columns 18. The exposed portions 78 of the stakes 77 are sized and shaped to be received within corresponding sockets 79 associated with the upper unit 5 to removably attach the upper unit 5 to the lower unit 3. In a preferred embodiment, the downwardly opening sockets 79 are defined by the interior walls of the columns 71 and include the hollow interiors thereof as best shown in FIG. 6. As a result, the exterior sides of the support columns 18 and 71 are smooth and uninterrupted eliminating obstructions and catchpoints. In similar fashion, the upper portions of the columns 71 include stakes 77 projecting upwardly therefrom for a purpose later described. When an upper unit 5 is mounted onto a lower unit, the lower cross braces 73 of the upper unit rest on the upper cross braces 19 of the lower unit to provide additional structural integrity to the overall assembled rack 1.

Figure 10:
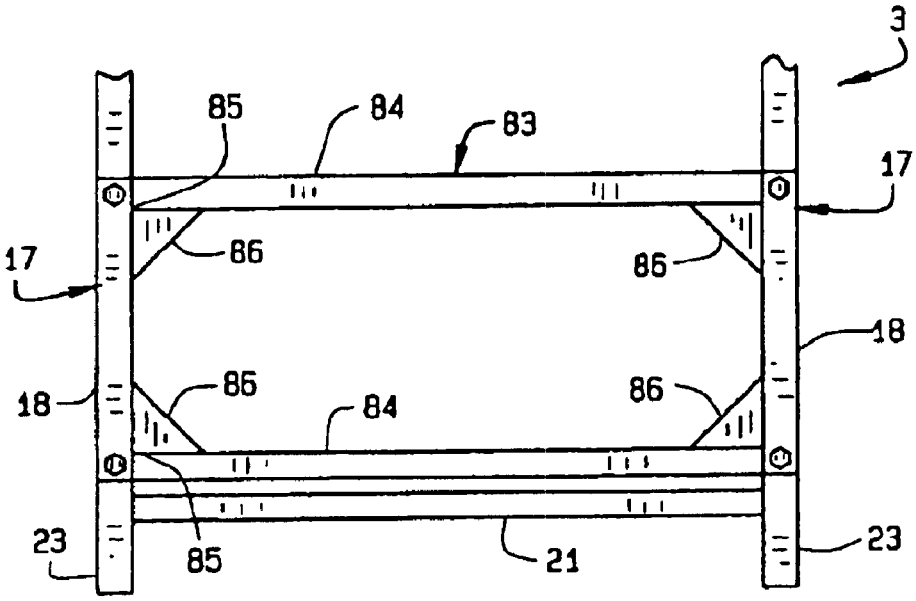
FIG. 10 is a fragmentary rear elevational view of the lower unit of the product display rack of FIG. 1 showing the details of a brace assembly associated therewith.

Reinforcement may be provided to help reduce side-to-side flexing of the rack 1. In the illustrated embodiment, a brace frame 83 (FIG. 10) is secured to the rear portion of the support structures 17 of the base unit 3. The brace frame 83 may include a single member, a pair of members 84, or a pair of members 84 joined by additional brace members (not shown) extending between the braces 84 such as adjacent one side of the columns 18. The brace frame 83 may be welded or otherwise attached to the support structures 17 in any suitable manner such as with screw fasteners. The corners 85 of the brace frame 83 are reinforced with gussets 86. By being secured to the rear columns 18, free access to product from the front of the rack 1 is provided. It has been found that bracing the lower unit 3 is adequate for reducing side-to-side flexing of the rack 1 including flexing of the upper unit 5.

Figure 11:
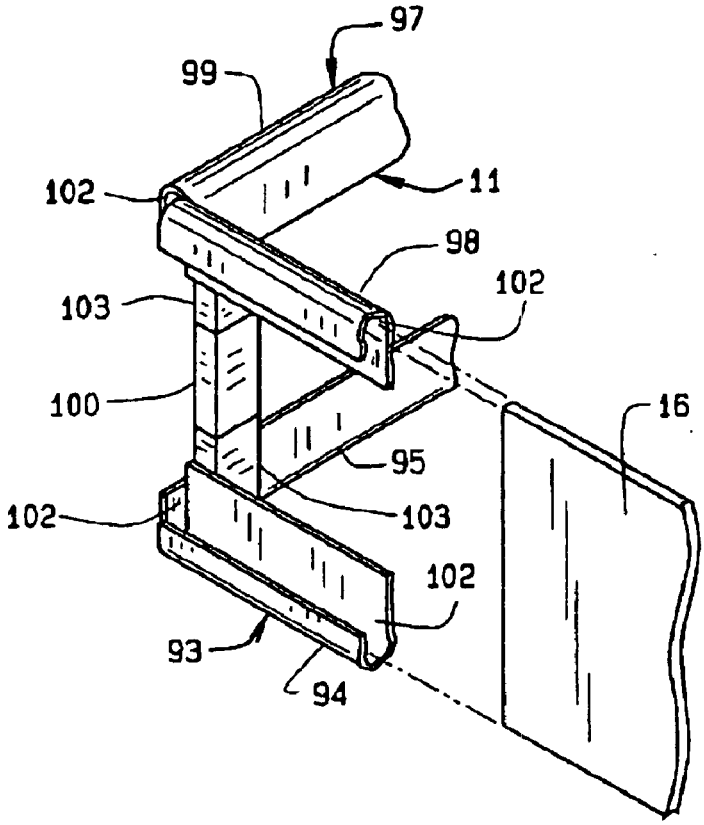
FIG. 11 is an enlarged fragmentary perspective view of a corner portion of the header assembly showing details of the construction of the header assembly and an advertising display panel.

The header assembly 11 (FIGS. 1, 2 and 11) includes a generally rectangular lower base frame 93. The frame 93 includes opposed front and rear side-to-side structural members 94, and opposed front-to-rear side structural members 95 secured at opposite ends of the members 94 to form the generally rectangular base frame 93. A generally rectangular upper frame 97, like the lower frame 93, includes a pair of opposed side-to-side structural members 98 and a pair of opposed front-to-rear structural members 99. Upright structural members 100 are positioned adjacent the respective corners of the lower frame 93 and upper frame 97 to secure the upper frame 97 in spaced relation to the lower frame 93. As illustrated, the upper frame 97 is larger than the lower frame 93 and slightly overhangs the lower frame 93. In another embodiment, the uprights 100 may be sleeved into corner sockets 103 as shown in FIG. 11 to permit separation of the upper frame 97 from the lower frame 93 to reduce the volume of the header assembly for shipping purposes. The uprights 100 can also be provided with pins (not shown) that fit into the sockets 103. Structural members 94, 95, 98 and 99 are provided with channels 102 extending along the length of the respective members as best shown in FIG. 11. The channels 102 in the upper frame 97 face generally downwardly while the channels 102 in the lower frame 93 open generally upwardly and toward the channels 102 in the upper frame 97. The channels 102 are adapted to receive advertising panels 16 therein for mounting the panels in a removable manner. The panels 16 will generally include indicia thereon for promoting and advertising the products 15 displayed on the rack 1. While the advertising panels 16 in the illustrated structure slope downwardly and inwardly from the upper frame 97 to the lower frame 93 because the upper frame is larger than the lower frame, it is recognized and anticipate that other orientations may be utilized such as the panels 16 being mounted in a vertical orientation. The panels 16 are removably changeable to promote different products.

Means are provided for removably mounting the header assembly 11 onto the upper unit 5. In the illustrated embodiment, the means include a pair of front-to-rear supports 106 (FIG. 1) secured to the opposed side-to-side members 94, each support 106 having and depending therefrom a pair of socket members 107 for receiving respectively therein the upwardly extending stakes 77 associated with the corresponding columns 71 of each support structure 69. This allows the header assembly 11 to be easily removably mounted to an upper unit 5 by vertical movement of the header assembly 11 relative to the support structures 69.

Figure 7:
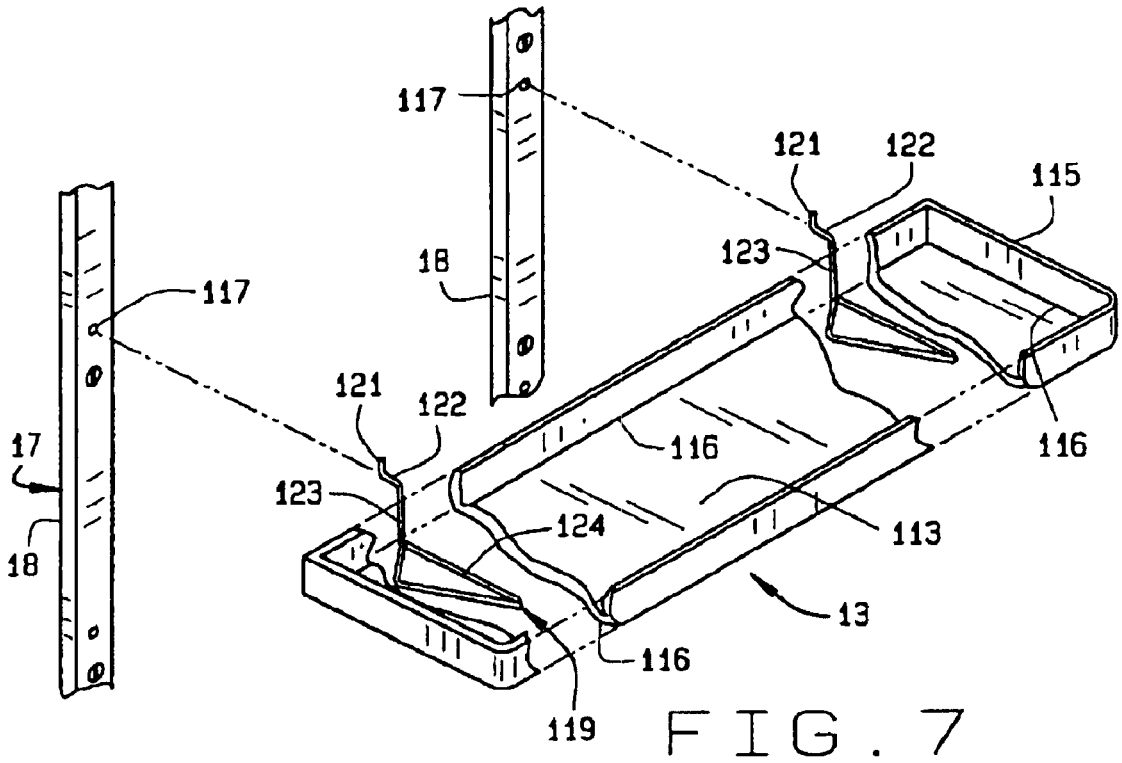
FIG. 7 is an enlarged, exploded fragmentary perspective view of an auxiliary side shelf member with associated brackets.

To provide versatility, side shelf members 13 are also provided. The side shelves 13 as best shown in FIG. 7 each include a floor portion 113 having a peripheral upstanding wall 115 positioned adjacent to marginal edges 116 of the floor 113. Means are provided for removably mounting the shelf members 13 to the upright support structures 17 and 69. In this regard, the upright columns 18 and 71 each include a plurality of vertically spaced apart apertures 117. Any number of apertures 117 may be provided to provide for adjustability of the vertical positioning of the side shelf members 13. The shelf members 13 are provided with mounting brackets 119 which form a cantilever support for the respective shelf members 13. Mounting brackets 119 can be made of formed round rod or wire members having a catch 121 with a shoulder 122 insertable into a respective aperture 117. The shoulder 122 will rest on the lower surface of an aperture 117 to support the shelf member vertically. A leg portion 123 depends from the shoulder 122 and is engageable with an outer face of a respective column 18 or 71 (FIG. 2) to provide resistance to a bending moment about the shoulder 122 when product is placed on floor portion 113. The brackets 119 also include a cantilever beam portion 124 which provide support to the bottom side of floor portion 113. The brackets 119 can be either permanently affixed to the shelf members 13 or they can be removably attached thereto.

The stake and socket arrangement for connecting the base unit 3 to the upper unit 5 and for connecting the header assembly 11 to an upper unit 5 has been illustrated with the stakes 77 extending upwardly from their respective subassemblies 3 and 5, while the sockets 79 which receive the stakes 77 therein open downwardly. It is to be understood that the sockets 79 may open upwardly while the stakes 77 extend downwardly, which is the reverse of that shown and described above. Also, combinations of upwardly and downwardly opening sockets 79 and upwardly and downwardly extending stakes 77 may likewise be used.

Thus, there has been shown and described several embodiments of a novel product display rack. As is evident from the foregoing description, certain aspects of the present invention are not limited by the particular details of the examples illustrated herein and it is therefore contemplated that other modifications and applications, or equivalents thereof, will occur to those skilled in the art. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed:

1. A display rack structure comprising:

a first rack subassembly having a pair of first front positioned upright support members and a pair of first rear positioned upright support members, said first rack subassembly being adapted to rest upon a supporting floor surface and having a first plurality of shelf members attached to at least some of said first upright support members, said first shelf members being carried in vertically spaced relationship, said shelf members being inclined downwardly in a direction from the respective first rear support members to the respective first front support members or oriented generally horizontally and having generally upwardly facing product support surfaces extending between the first front positioned upright support members and the first rear positioned upright support members;

a second rack subassembly having a pair of second front positioned upright support members and a pair of second rear positioned upright support members, said second rack subassembly being adapted to be supported by said first rack subassembly in an elevated position superimposed on said first rack subassembly and having a plurality of second shelf members attached to at least some of said second upright support members with said second shelf members being carried in vertically spaced relationship in said second rack subassembly, said second shelf members being inclined downwardly in a direction from the respective second rear support members to the respective second front support members or oriented generally horizontally and having generally upwardly facing product support surfaces extending between the second front positioned upright support members and the second rear positioned upright support members; and connectors cooperating with at least some of said first and second upright support members for removably attaching said second rack subassembly to said first rack subassembly, said first and second rack subassemblies being constructed and assembled for shipping as separate subassemblies and adapted to be placed one upon the other to effect connection therebetween by said connectors thereby forming a display rack structure from said subassemblies with shelf members preattached to the respective subassembly;

at least one of said plurality of shelf members including a product organizer member which defines a plurality of product receiving channels associated with said shelf member, said product organizer member forming a product retention opening at the front of each product channel, said product retention opening having a transverse dimension less than the width of a respective product channel.

2. The display rack structure as set forth in claim 1 wherein said connectors include a plurality of stakes associated with at least some of said first upright support members and a plurality of receiving sockets associated with at least some of said second upright support members, each of said stakes being insertably receivable within a corresponding socket when said second rack subassembly is supported by said first rack subassembly.

3. The display rack structure as set forth in claim 1 wherein said connectors include a plurality of stakes associated with at least some of said second upright support members and a plurality of receiving sockets associated with at least some of said first upright support members, each of said stakes being insertably receivable within a corresponding socket when said second rack subassembly is supported by said first rack subassembly.

4. The display rack structure as set forth in claim 1 including a header assembly for displaying indicia thereon, said header assembly including a plurality of connector members, said connector members being cooperatively engageable with at least some of said second upright support members for removably supporting said header assembly on top of said second rack subassembly.

5. The display rack structure as set forth in claim 4 wherein the connector members associated with said header assembly include a plurality of sockets, said sockets being adapted for receiving a corresponding stake associated with one end portion of at least some of said second upright support members.

6. The display rack structure as set forth in claim 4 wherein said header assembly includes at least one display panel removably mountable thereto, said display panel having indicia thereon.

7. The display rack structure as set forth in claim 1 wherein at least some of said plurality of shelf members include first and second members, said first member including a product support surface and said second member including spaced wire members forming guide rails for guiding products positioned therebetween, said second member being removably attachable to said first member.

8. The display rack structure as set forth in claim 1 wherein said display rack structure includes opposed front and rear portions and opposed side portions, said plurality of shelf members associated with said first and second rack subassemblies being positioned so as to present products in a front-to-rear orientation, said display rack structure further including a plurality of side shelf members removably attachable to at least some of said plurality of first and second upright support members, said side shelf members being attachable to the side portion of said display rack structure and presenting products in a side-to-side orientation.

9. The display rack structure as set forth in claim 8 wherein at least one of said side shelf members is removably attachable in a cantilever manner.

10. The display rack structure as set forth in claim 1 wherein said first rack subassembly includes a brace member secured to and extending between said first rear positioned upright support members to reduce side-to-side flexing of said display rack structure.

11. The display rack structure as set forth in claim 1 wherein each of said shelf members include a rack member forming an upwardly facing product support surface, and wherein each of said shelf members further includes said product organizer member, each of said product organizer members being releasably attached to a respective rack member through cooperative latch devices operably connecting a product organizer member to a respective rack member.

12. The display rack structure as set forth in claim 11 wherein said cooperative latch devices include transversely extending rail members each secured to a respective product organizer member and rack member whereby interengagement between the transversely extending rail members retains a product organizer member to a respective rack member in a resilient manner.

13. A display rack structure comprising:

a plurality of subassemblies, each subassembly including a plurality of front positioned and rear positioned upright support members and a plurality of shelf members attached to said respective said upright support members, one of said plurality of subassemblies being stackably attachable to another one of said plurality of subassemblies, said subassemblies being constructed and assembled for shipping and adapted to be placed one upon the other to effect connection therebetween thereby forming a display rack structure from said plurality of subassemblies;

each of said upright support members associated with one of said subassemblies having opposed end portions, one end portion of each of said upright support members of one of said subassemblies including a stake member and the opposite end portion of each of said upright support members of said one of said subassemblies including a socket, the stake members associated with the upright support members of said one of said subassemblies being cooperatively receivable within the sockets associated with the upright support members of another one of said subassemblies; and said plurality of shelf members associated with each of said subassemblies being in vertically spaced relationship, each of said shelf members being removably attached to the corresponding upright support members associated with each of said subassemblies prior to shipping, said shelf members being attached in either a gravity feed orientation or a substantially horizontal orientation with a generally upwardly facing product support and extending between the respective front positioned and rear positioned upright support members;

at least one of said plurality of shelf members including a product organizer member removably attached thereto, said product organizer member including a plurality of wire members, at least some of said wire members defining product receiving channels for guiding products therebetween, at least some of said wire members defining a product retention gate opening at the front of a respective product channel, each gate opening having a width dimensioned less than the width of a respective product channel.

14. The display rack structure as set forth in claim 13 including a plurality of side shelf members, each side shelf member being removably attachable to at least some of said upright support members associated with each of said subassemblies.

15. The display rack structure as set forth in claim 14 wherein each of said side shelf members includes at least one bracket member, said at least one bracket member enabling said side shelf members to be attached to at least some of said upright support members in a cantilever fashion.

16. The display rack structure as set forth in claim 13 wherein one of said subassemblies is adapted to rest upon a supporting floor surface.

17. The display rack structure as set forth in claim 13 including a header assembly mounted on a top positioned subassembly for carrying advertising indicia on the header assembly.

18. The display rack structure as set forth in claim 13 wherein each of said shelf members include a rack member forming an upwardly facing product support surface, and wherein each of said shelf members further includes said product organizer member, each of said product organizer members being releasably attached to a respective rack member through cooperative latch devices operably connecting a product organizer member to a respective rack member.

19. The display rack structure as set forth in claim 18 wherein said cooperative latch devices include transversely extending rail members secured to each of the product organizer members and rack members whereby interengagement between the transversely extending rail members retains a product organizer member to a respective rack member in a resilient manner.

20. A display rack structure comprising:

a base unit subassembly having front, rear and opposed side portions and including a plurality of front and rear positioned upright support members, said base unit subassembly including a plurality of shelf members attached to the base unit subassembly, said shelf members having generally upwardly facing product support members extending between the front and rear positioned upright support members and being positioned in one of a generally horizontal or gravity feed orientation, said base unit subassembly being adapted to rest upon a supporting floor surface;

an upper unit subassembly having front, rear and opposed side portions and including a plurality of front and rear positioned upright support members, said upper unit subassembly including a plurality of shelf members attached to the upper unit subassembly, said shelf members having generally upwardly facing product support members extending between the front and rear positioned upright support members and being positioned in one of a generally horizontal or gravity feed orientation, said upper unit subassembly being adapted for cooperative engagement with the base unit subassembly on top of said base unit subassembly to form a display rack structure from the subassemblies;

a header assembly having a plurality of support members associated therewith, said support members being cooperatively engageable with upper end portions of at least some of said plurality of upper unit subassembly upright support members, said header assembly including at least one removable panel for displaying advertising indicia thereon;

each of said shelf members including a removably attached product organizer member which cooperates with said shelf member to align and guide products supported by said shelf members and having a generally upwardly facing product support; and at least one side shelf member removably attachable to a side portion of at least one of said base unit subassembly and said upper unit subassembly.

21. The display rack structure as set forth in claim 20 wherein the upper end portions of the plurality of base unit subassembly upright support members include stake members, and wherein the lower end portions of the plurality of upper unit subassembly upright support members include receiving sockets, the stake members associated with said base unit subassembly being cooperatively receivable within the receiving sockets associated with said upper unit subassembly.

22. The display rack structure as set forth in claim 20 herein the upper end portions of the plurality of base unit subassembly upright support members include receiving sockets, and wherein the lower end portions of the plurality of upper unit subassembly upright support members include stake members, the stake members associated with said upper unit subassembly being cooperatively receivable within the receiving sockets associated with said base unit subassembly.

23. The display rack structure as set forth in claim 20 wherein the upper end portions of the plurality of upper unit subassembly upright support members include stake members, and wherein the lower portions of the plurality of upright support members associated with said header assembly include receiving sockets, the stake members being cooperatively receivable within the receiving sockets of said header assembly.

24. The display rack structure as set forth in claim 20 wherein the upper end portions of the plurality of upper unit subassembly upright support members include receiving sockets, and wherein the lower portions of the plurality of header assembly upright support members include stake members, the stake members being cooperatively receivable within the receiving sockets.

25. The display rack structure as set forth in claim 20 wherein said side shelf members are mountable in a cantilever manner with respect to the side portions of said base unit subassembly and said upper unit subassembly.

26. The display rack structure as set forth in claim 20 wherein said header assembly is substantially rectangular in shape, said header assembly being adapted to removably receive a display panel on each side of said rectangular configuration.

27. The display rack structure as set forth in claim 20 wherein said base unit subassembly includes at least one brace member secured to the rear portion thereof to reduce side-to-side flexing of said display rack when said upper unit subassembly and said header assembly are attached thereto.

28. The display rack structure as set forth in claim 20 wherein each of said shelf members include a rack member forming an upwardly facing product support surface, each product organizer member being releasably attached to a rack member through cooperative latch devices operably connecting the product organizer member to a respective rack member.

29. The display rack structure as set forth in claim 28 wherein said cooperative latch devices include transversely extending rail members secured to each of the product organizer members and rack members whereby interengagement between the transversely extending rail members retains a product organizer member to a respective rack member in a resilient manner.

* * * * *

UNITED STATES PATENT AND TRADEMARK OFFICE

CERTIFICATE OF CORRECTION

PATENT NO. : 6,880,708 B2
DATED : April 19, 2005
INVENTOR(S) : Andrew J. Boron

It is certified that error appears in the above-identified patent and that said Letters Patent is hereby corrected as shown below:

Title page,
Item [73], Assignee, delete "PFI, LLC, St. Louis, MO" and replace with -- Partnership for Innovation, LLC, Owensville, MO --

Column 12,
Line 5, delete "herein" and replace with -- wherein --

Signed and Sealed this

Twenty-eighth Day of June, 2005

JON W. DUDAS
*Director of the United States Patent and Trademark Office*